US009267397B2

(12) United States Patent
Itoafa et al.

(10) Patent No.: US 9,267,397 B2
(45) Date of Patent: Feb. 23, 2016

(54) HYDRAULIC VALVE TRAIN OF AN INTERNAL COMBUSTION ENGINE

(75) Inventors: Calin Petru Itoafa, Höchstadt (DE); Hermann Keller, Dillingen (DE)

(73) Assignee: SCHAEFFLER TECHNOLOGIES AG & CO. KG, Herzogenaurach (DE)

( * ) Notice: Subject to any disclaimer, the term of this patent is extended or adjusted under 35 U.S.C. 154(b) by 0 days.

(21) Appl. No.: 13/985,943

(22) PCT Filed: Nov. 17, 2011

(86) PCT No.: PCT/EP2011/070324

§ 371 (c)(1),
(2), (4) Date: Oct. 22, 2013

(87) PCT Pub. No.: WO2012/110120

PCT Pub. Date: Aug. 23, 2012

(65) Prior Publication Data

US 2014/0048024 A1 Feb. 20, 2014

(30) Foreign Application Priority Data

Feb. 18, 2011 (DE) ..... 10 2011 004 403

(51) Int. Cl.
*F01L 9/02* (2006.01)
*F01L 1/34* (2006.01)
*F01L 1/16* (2006.01)

(52) U.S. Cl.
CPC ... *F01L 1/34* (2013.01); *F01L 1/16* (2013.01); *F01L 9/02* (2013.01); *F01L 9/025* (2013.01); *F01L 2103/00* (2013.01)

(58) Field of Classification Search
CPC ... F01L 2001/34426; F01L 13/06; F01L 9/02; F01L 1/245; F01L 9/025; F01L 9/023; F01L 9/021; F01L 1/24; F02D 13/0226; F02D 13/0253
USPC ..... 123/90.11, 90.1, 90.12, 320, 321
See application file for complete search history.

(56) References Cited

U.S. PATENT DOCUMENTS 6,918,364 B2 * 7/2005 Vattaneo et al. ..... 123/90.55
7,210,438 B2 * 5/2007 Canino et al. ..... 123/90.55

(Continued)

FOREIGN PATENT DOCUMENTS

CN 101389831 A 3/2009
EP 1 245 799 10/2002

(Continued)

OTHER PUBLICATIONS

Office Action issued in CN 201180067935.6 dated Feb. 2, 2015 (5 pages).

*Primary Examiner* — Jesse Bogue
*Assistant Examiner* — Daniel Bernstein
(74) *Attorney, Agent, or Firm* — Fitzpatrick, Cella, Harper & Scinto

(57) ABSTRACT

The invention proposes a subassembly of a hydraulic variable valve train of an internal combustion engine, having a guide bushing (4) that can be installed in a hydraulic housing (3), and having a piston (5) supported therein so as to be axially movable for actuating a gas exchange valve (1), and having a valve element (7) that, together with the end face (10) of the piston distant from the gas exchange valve, defines a hydraulic pressure chamber (11) in the guide bushing, wherein the valve element is a throttle check valve that allows hydraulic medium to flow out of the pressure chamber throttled by a continuously open throttle opening (16) and allows hydraulic medium to flow into the pressure chamber with little throttling by a ball check valve (17). The subassembly is intended to be implemented as a modular unit assembled outside of the hydraulic housing, wherein the guide bushing and the valve element are fastened to one another, and the piston is secured in a captive manner in the guide bushing.

5 Claims, 3 Drawing Sheets

(56) References Cited

U.S. PATENT DOCUMENTS

| | | | | |
|---|---|---|---|---|
| 7,954,464 | B2 * | 6/2011 | Proschko | 123/90.12 |
| 2005/0034691 | A1 * | 2/2005 | Chang | 123/90.12 |
| 2009/0000580 | A1 * | 1/2009 | Proschko | 123/90.11 |
| 2012/0292541 | A1 * | 11/2012 | Rinnert et al. | 251/30.01 |

FOREIGN PATENT DOCUMENTS

| | | |
|---|---|---|
| EP | 1 344 900 | 9/2003 |
| EP | 2 009 255 | 12/2008 |
| EP | 2 060 755 | 5/2009 |

* cited by examiner

HYDRAULIC VALVE TRAIN OF AN INTERNAL COMBUSTION ENGINE

The invention concerns a subassembly of a hydraulic variable valve train of an internal combustion engine, having a guide bushing that can be installed in a hydraulic housing, and having a piston supported therein so as to be axially movable for actuating a gas exchange valve, and having a valve element located in a fixed position on the end section of the guide bushing distant from the gas exchange valve. Together with the end face of the piston distant from the gas exchange valve, this valve element defines a hydraulic pressure chamber in the guide bushing, wherein the valve element is a throttle check valve that allows hydraulic medium to flow out of the pressure chamber throttled by a continuously open throttle opening and allows hydraulic medium to flow into the pressure chamber with little throttling by a ball check valve.

BACKGROUND OF THE INVENTION

An electro-hydraulic variable valve train with a generic subassembly is apparent from EP 1,344,900 A2. An important element of this valve train—which operates, as is generally known, according to the so-called lost motion principle—in which a so-called hydraulic linkage with variable, controllable hydraulic volume runs between the input end, which is to say the cam of a camshaft, and the output end, which is to say the gas exchange valve, is a hydraulic valve brake that controls the contact speed of the closing gas exchange valve independently of the cam position and limits it to predefined values that are acoustically and mechanically acceptable.

The hydraulic valve brake is a valve element implemented as a throttle check valve. The controlled braking of the piston and consequently of the gas exchange valve, which is spring-loaded in the closing direction, is accomplished by means of the throttle opening, which produces a strong throttling of the hydraulic medium displaced from the pressure chamber in the final closing phase of the gas exchange valve. By contrast, the purpose of the ball check valve that is closed during the valve closing phase is to permit a fast initial opening speed of the gas exchange valve in that an essentially unthrottled, and accordingly comparatively large, volume flow can enter the pressure chamber when the valve ball is then opened.

The valve element is located in a fixed position in a hydraulic housing that is placed in the cylinder head of the internal combustion engine and includes the primary elements of the hydraulic valve train. The valve element is fastened in the hydraulic housing by means of a screw that braces a guide bushing against the valve element and braces the valve element against the hydraulic housing.

OBJECT OF THE INVENTION

The object of the present invention is to modify the design of the initially mentioned subassembly such that its assembly and functional testing are simplified during manufacture of the valve train.

SUMMARY OF THE INVENTION

The achievement of this object is evident from the characterizing features of claim 1. According thereto, the subassembly is intended to be implemented as a modular unit assembled outside of the hydraulic housing, wherein the guide bushing and the valve element are fastened to one another, and the piston is secured in a captive manner in the guide bushing. A subassembly of this nature has advantages in many regards. Resistance to incorrect assembly is improved, since the individual elements of the subassembly and in particular the valve element and guide bushing do not have to be installed separately from one another in the hydraulic housing, and consequently the risk of assembly errors, such as crooked/tilted placement or the omission of individual elements, is reduced. However, an important advantage results from the fact that the operational function of the subassembly, and in particular the function of the hydraulic valve brake, can be measured or tested even before its installation in the hydraulic housing. In this way, it is possible not only to reject defective parts early, which is to say prior to installation in the hydraulic housing, but also to group good parts in terms of uniform valve stroke distribution so that, for example, the hydraulic valve braking function of all modules installed in a hydraulic housing has a narrow range of variation predetermined by the grouping.

In a further refinement of the invention, provision is made for the valve element to have a valve housing that the throttle opening passes through and that is equipped with the valve seat of the ball check valve, and that is placed in the end section of the guide bushing distant from the gas exchange valve. In alternative embodiments to this, the valve housing can also be fastened to the guide bushing so as to overlap the end section of the guide bushing distant from the gas exchange valve or to rest flat thereon. Possible fastening methods include material-to-material joining, such as welding, interlocked joining, such as screwing or peening, and frictional joining, such as pressing.

Preferably the end section of the guide bushing distant from the gas exchange valve is provided with a cylindrical counterbore in which the valve housing is fastened by means of a press fit and is axially supported on an axial shoulder formed by the counterbore. The support can be direct or by means of a spacer clamped between the valve housing and the axial shoulder. Furthermore, the valve housing should extend radially inward beyond the axial shoulder and serve as an axial end stop for the end face of the piston distant from the gas exchange valve. In this design, a transverse bore passes through the guide bushing and intersects with the counterbore in such a manner that the axial shoulder has a hollow whose cross-section is delimited in the shape of a circular segment by the valve housing or by the spacer, depending on the type of support.

The transverse bore, like the throttle opening, serves to brake the gas exchange valve in the closing phase. In contrast to the throttle opening, however, the transverse bore is traveled over by the piston, so that its free or effective flow cross-section depends on the instantaneous axial position of the piston. A favorable throttling characteristic of the transverse bore is produced when the transverse bore has an effective cross-section that is not circular, but instead only has the shape of a circular segment, as for example a semicircle. And such a cross-section is produced by the geometric interplay in accordance with the invention of the transverse bore (produced in the shape of a circle), its intersection with the counterbore, and the delimiting by the valve housing or by the intermediate plate.

Moreover, the valve housing is also intended to have a flange extending radially outward that is clamped axially between the axial shoulder and a first end face of a fastening ring, wherein the outer shell of the fastening ring and the inner shell of the counterbore form the press fit. For the case in which the fastening ring projects axially beyond the valve housing in the direction distant from the gas exchange valve and the second end face of the fastening ring serves to axially support the modular unit in the hydraulic housing, the fastening ring should be provided with a hydraulic medium passage in the region of its second end face. Alternatively, the modular unit can also be supported in the hydraulic housing directly at the guide bushing, for example at its end section distant from the gas exchange valve, and not through the valve housing fastened thereto. The fastening ring is preferably made of aluminum or steel material.

In an alternative embodiment without a fastening ring, provision can also be made for the outer shell of the valve housing and the inner shell of the counterbore to form the press fit.

BRIEF DESCRIPTION OF THE DRAWINGS

Additional features of the invention are evident from the description below, and from the drawings, which show exemplary embodiments of the invention. Unless otherwise noted, features or components that are identical or functionally identical are labeled with the same reference numbers. The drawings show.

DETAILED DESCRIPTION OF THE DRAWINGS

Figure 1:
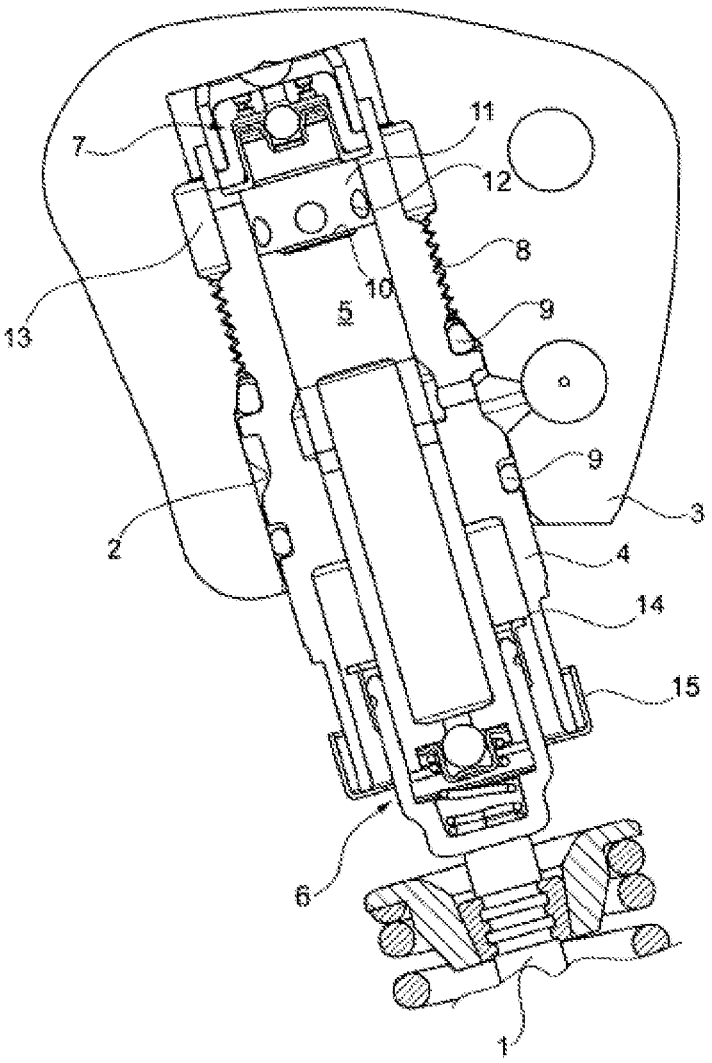
FIG. 1 a modular unit installed in a hydraulic housing of an electro-hydraulic variable valve train shown in longitudinal section.

FIG. 1 shows the output end of a hydraulic valve train of an internal combustion engine that is used for variable-stroke actuation of a gas exchange valve 1 that is spring-loaded in the closing direction. A subassembly of the valve train installed in a receptacle 2 of a hydraulic housing 3 includes a guide bushing 4, a piston 5, a hydraulic valve lash compensation element 6, and a valve element 7. The guide bushing 4 is fastened in the hydraulic housing 3 by means of a threaded connection 8 and sealing rings 9 so as to be as hydraulic-fluid-tight as possible. The piston 5 and the valve lash compensation element 6 are supported in an axially movable manner in the guide bushing 4 in axial series connection. The valve element 7 is located in a fixed position on the end section of the guide bushing 4 distant from the gas exchange valve and, together with the end face 10 of the piston 5 distant from the gas exchange valve, defines a pressure chamber 11 in the guide bushing 4. This output-end pressure chamber 11 communicates in a known manner, via transfer passages 12 in the guide bushing 4 and via the valve element 7 serving as a hydraulic valve brake, with a pressure chamber 13 on the input end whose hydraulic medium volume is partially or fully controlled by means of an electrically operated hydraulic valve in a pressure relief chamber (neither of which is shown) in order to produce stroke variability at the gas exchange valve 1.

According to the invention, the subassembly forms a modular unit assembled outside of the hydraulic housing 3 and tested for its hydraulic function and optionally grouped by predefined parameters. The guide bushing 4 and the valve element 7 are fastened to one another in this design, and the piston 5, together with the valve lash compensation element 6, is secured in a captive manner in the guide bushing 4. This securing is achieved by interlocking means with an axial stop, in that a flange bushing 14 fastened onto the compensator housing of the valve lash compensation element 6 axially contacts an angle ring 15 attached to the guide bushing 4. It is a matter of course that the axial stop does not come into operation in the installed operating state, but instead only in the uninstalled state of the modular unit in order to prevent the valve lash compensation element 6 and the piston 5 from falling out of the guide bushing 4 at that time, with the free stroke of the axial stop being dimensioned correspondingly large.

Figure 2:
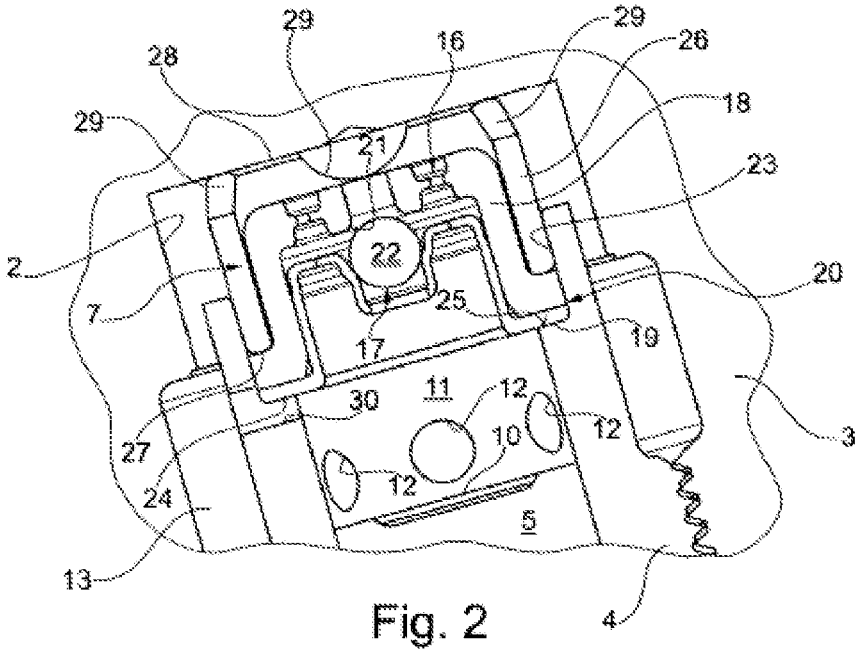
FIG. 2 the fastening of the valve housing in the guide bushing with a fastening ring as shown in FIG. 1 in an enlarged representation.

The valve element 7 and its attachment to the guide bushing 4 are shown in an enlarged representation in FIG. 2. As described at the outset, the valve element 7 is a throttle check valve with a continuously open throttle opening 16, which strongly throttles the flow of hydraulic medium out of the pressure chamber 11 in the final closing phase of the gas exchange valve 1, and with a ball check valve 17 that allows hydraulic medium to flow into the pressure chamber 11 with little throttling in the initial opening phase of the gas exchange valve 1. The valve element 7 includes a valve housing 20 composed of an outside cap 18 and an inside cap 19, wherein the throttle opening 16 and the valve seat 21 for the valve ball 22 extend in or on the outside cap 18, and the valve ball 22 is retained in an axially movable manner by the inside cap 19.

The valve housing 20 is placed in a cylindrical counterbore 23 of the guide bushing 4 and is braced axially against an axial shoulder 25 formed by the counterbore 23 by means of a flange 24 extending radially outward. The valve housing 20 is fastened in the guide bushing 4 by means of a fastening ring 26 whose outer shell forms a press fit with the inner shell of the counterbore 23 and whose first end face 27 braces the flange 24 against the axial shoulder 25.

The fastening ring 26 projects axially beyond the valve housing 20, and the second end face 28 of the fastening ring 26 axially supports the modular unit on the bottom of the receptacle 2 of the hydraulic housing 3. Four recesses 29 that interrupt the second end face 28 serve as hydraulic medium passages between the pressure chamber 13 on the input end and the valve housing 20.

The valve housing 20 extends radially inward beyond the axial shoulder 25 to form an axial end stop for the end face 10 of the piston 5 distant from the gas exchange valve, corresponding to the closed position of the gas exchange valve 1. As is also evident from comparison with FIG. 5 or FIG. 6, a transverse bore 30 passes through the guide bushing 4 axially above the transfer passages 12. This transverse bore, like the throttle opening 16, causes a braking of the closing gas exchange valve 1 in that the retracting piston 5 successively covers the transverse bore 30 and accordingly successively reduces the cross-sectional area available for the outflowing hydraulic medium. A piston stroke/cross-section curve that is especially suitable for the braking characteristics is produced when the effective cross-section of the transverse bore 30 is not circular, but instead has only the shape of a circular segment. To this end, the transverse bore 30, which is produced with a circular cross-section, intersects with the counterbore 23 in such a manner that the axial shoulder 25 has a hollow 31. The cross-section of this hollow is delimited to the shape of a circular segment, here approximately a semicircle, by the valve housing 20 resting on the axial shoulder 25.

Figure 3:
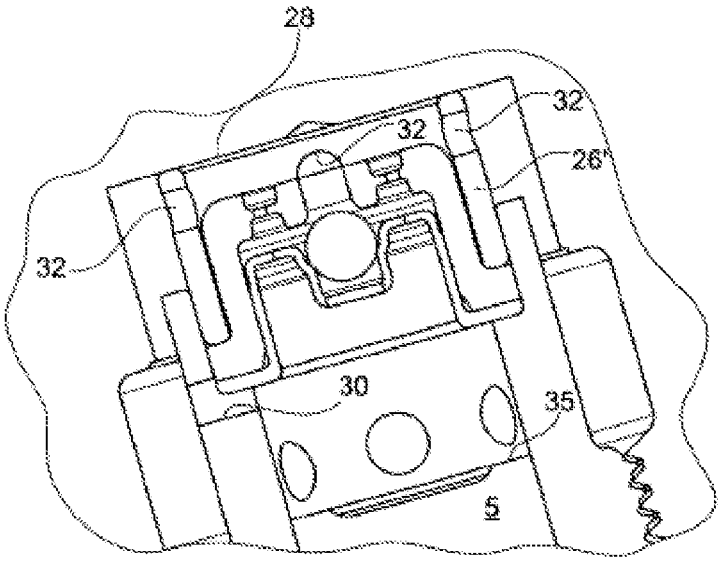
FIG. 3 an alternative embodiment of the modular unit with a modified fastening ring as compared to FIG. 1, shown in a representation corresponding to FIG. 2.

The sole difference between the exemplary embodiment disclosed in FIG. 3 and the above-described example is the hydraulic medium passage in the form of bores 32, which pass through the fastening ring 26' in the region of its second end face 28.

Figure 4:
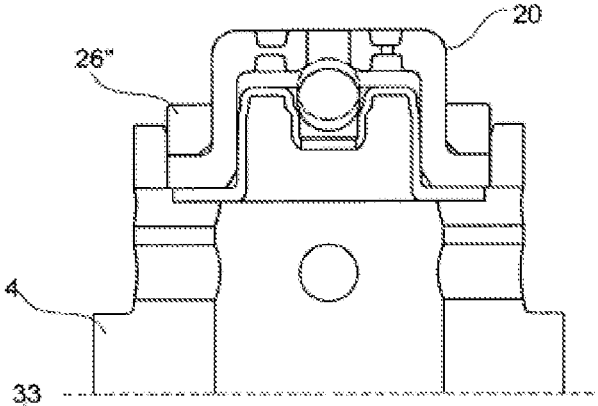
FIG. 4 an alternative embodiment of the modular unit with a narrow fastening ring, shown in a representation corresponding to FIG. 2.

The difference between the exemplary embodiment disclosed in FIG. 4 and the above-described examples is a narrow fastening ring 26", which does not project axially beyond the valve housing 20, but instead is set back therefrom. Accordingly, axial support of the modular unit in the hydraulic housing 3 is accomplished directly on an end face of the guide bushing 4.

Figure 5:
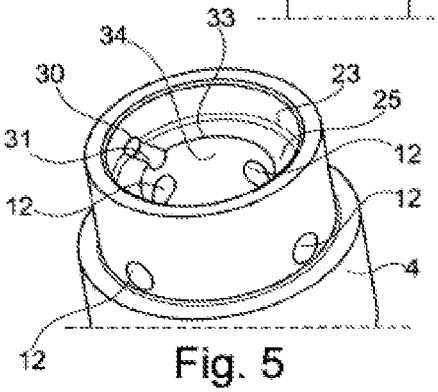
FIG. 5 a perspective view of a cylindrical counterbore with sharp interior corners in the guide bushing.
Figure 6:
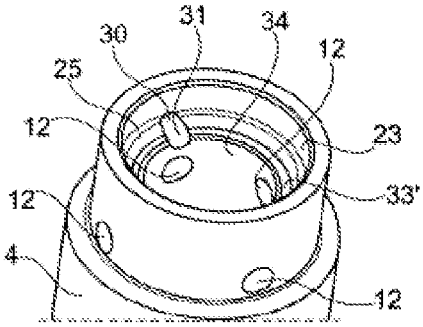
FIG. 6 a perspective view of an internally chamfered cylindrical counterbore in the guide bushing.

FIGS. 5 and 6 show two versions of the cylindrical counterbore 23, namely one with a sharp-edged transition 33 to the piston guide bore 34 and one with a chamfered or rounded transition 33' to the piston guide bore 34. The design of the transition, in conjunction with the design of the upper piston edge 35 (see FIG. 3, where it is sharp-edged), significantly influences the flow characteristics of the hydraulic medium flowing from the transverse bore 30 just before the end position of the retracting piston 5.

Figure 7:
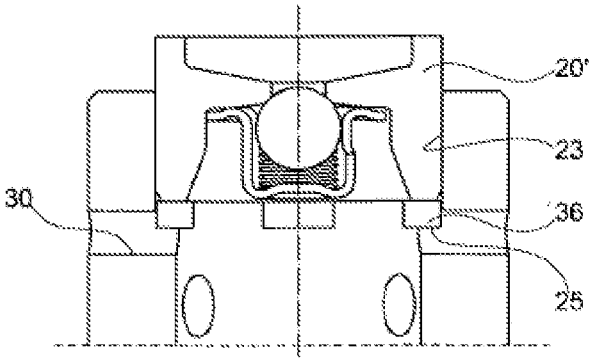
FIG. 7 an alternative embodiment of the modular unit without a fastening ring, shown in a representation corresponding to FIG. 2.

FIG. 7 shows another exemplary embodiment with no separate fastening ring. In this case, the outer shell of the flangeless cylindrical valve housing 20' is pressed into the inner shell of the counterbore 23 and braced against the axial shoulder 25 by means of a spacer 36. In analogous fashion to the above explanations, the spacer 36, implemented as a perforated disk, serves as an axial end stop for the piston 5 on the one hand, and to delimit the transverse bore 30 in the shape of a circular segment on the other hand. The valve housing 20' is derived from mass production of conventional hydraulic valve lash compensation elements, where it is used as a compensating piston. The throttle opening required for the use here as a throttle check valve is not visible in the cross-sectional representation. Also not shown is a hydraulic medium passage at the end face of the valve housing 20' distant from the exchange valve, which is necessary when the modular unit is supported on the bottom of the receptacle 2 of the hydraulic housing 3 by means of the valve housing 20'.

LIST OF REFERENCE NUMERALS

1 gas exchange valve
2 receptacle of the hydraulic housing
3 hydraulic housing
4 guide bushing
5 piston
6 valve lash compensation element
7 valve element
8 threaded connection
9 sealing ring
10 end face of the piston distant from the gas exchange valve
11 pressure chamber on the output end
12 transfer passage
13 pressure chamber on the input end
14 flange bushing
15 angle ring
16 throttle opening
17 ball check valve
18 outside cap of the valve housing
19 inside cap of the valve housing
20 valve housing
21 valve seat
22 valve ball
23 counterbore
24 flange
25 axial shoulder
26 fastening ring
27 first end face of the fastening ring
28 second end face of the fastening ring
29 recess/hydraulic medium passage
30 transverse bore
31 hollow
32 bore/hydraulic medium passage
33 transition to the piston guide bore
34 piston guide bore
35 upper edge of the piston
36 spacer

The invention claimed is:

1. A subassembly of a hydraulic variable valve train for an internal combustion engine, the subassembly comprising:

a guide bushing that can be installed in a hydraulic housing;

a piston supported in the guide bushing so as to be axially movable for actuating a gas exchange valve and being secured in a captive manner in the guide bushing; and a valve element that is located in a fixed position on an end section of the guide bushing distant from the gas exchange valve and that, together with an end face of the piston distant from the gas exchange valve, defines a hydraulic pressure chamber in the guide bushing, the valve element providing a throttle check valve that (i) allows a hydraulic medium to flow out of the pressure chamber throttled by a continuously open throttle opening and (ii) allows the hydraulic medium to flow into the pressure chamber with little throttling by a ball check valve, wherein the valve element has a valve housing through which the throttle opening passes and which provides a valve seat for the ball check valve, the valve housing being placed in the end section of the guide bushing distant from the gas exchange valve, and wherein the guide bushing and the valve element are fastened to one another, and the end section of the guide bushing distant from the gas exchange valve has a cylindrical counterbore in which the valve housing is fastened by a press fit and is axially supported on an axial shoulder formed by the counterbore, wherein the subassembly is provided as a modular unit assembled separately from the hydraulic housing.

2. The subassembly according to claim 1, wherein the valve housing, or a spacer clamped between the axial shoulder and the valve housing, extends radially inward beyond the axial shoulder, providing an axial end stop for the end face of the piston distant from the gas exchange valve, and wherein a transverse bore passes through the guide bushing and intersects the counterbore such that the axial shoulder has a hollow having a cross-section which is delimited in the shape of a circular segment by the valve housing or the spacer.

3. The subassembly according to claim 1, further comprising a fastening ring, wherein the valve housing comprises a flange extending radially outward which is clamped axially between the axial shoulder and a first end face of the fastening ring, and wherein an outer shell of the fastening ring and an inner shell of the counterbore provide a press fit.

4. The subassembly according to claim 3, wherein the fastening ring projects axially beyond the valve housing in a direction away from the gas exchange valve, and a second end face of the fastening ring axially supports the modular unit in the hydraulic housing, the fastening ring having a hydraulic medium passage in a region of the second end face.

5. The subassembly according to claim 1, wherein the outer shell of the valve housing and an inner shell of the counterbore form a press fit.

* * * * *